US005729915A

United States Patent [19]

Khoo et al.

[11] Patent Number: 5,729,915

[45] Date of Patent: Mar. 24, 1998

[54] PROTECTIVE BOOT FOR FOOTWEAR

[76] Inventors: John C. Q. Khoo, 57 Arkendo Drive, Oakville, Ontario, Canada, L6J 5T8; Gote Jonasson, Tegelbruksgatan 7, 654 80, Karlstad, Sweden; Thomas Buchar, Box 681, 551 19, Jonkoping, Sweden

[21] Appl. No.: 682,083

[22] Filed: Jul. 17, 1996

[51] Int. Cl.[6] ..... A43B 3/16; A43B 1/02

[52] U.S. Cl. ..... 36/7.1 R; 36/9 R

[58] Field of Search ..... 36/7.1 R, 7.3, 36/7.5, 9 A, 87, 88, 2 R, 9 R

[56] References Cited

U.S. PATENT DOCUMENTS

| | | | |
|---|---|---|---|
| D. 267,832 | 2/1983 | Pask | D2/4 |
| D. 291,140 | 8/1987 | Gjendemsjo | D2/267 |
| 1,312,781 | 8/1919 | Flannery . | |
| 1,644,217 | 10/1927 | Wreford . | |
| 1,865,709 | 7/1932 | Slocum . | |
| 2,176,463 | 10/1939 | Meendsen | 36/7.1 R |
| 4,538,368 | 9/1985 | Mugford | 36/7.1 R X |
| 4,616,428 | 10/1986 | Leger | 36/7.1 R |
| 4,788,780 | 12/1988 | Boggs | 36/7.1 R |
| 4,809,447 | 3/1989 | Pacanowsky et al. | 36/9 R |
| 5,067,260 | 11/1991 | Jenkins, Jr. | 36/7.1 R |

FOREIGN PATENT DOCUMENTS

| | | | |
|---|---|---|---|
| 1889 | 5/1915 | United Kingdom | 36/7.3 |

*Primary Examiner*—B. Dayoan
*Attorney, Agent, or Firm*—Larson & Taylor

[57] ABSTRACT

A protective overboot for wear over the footwear of a user includes a sole member of a one piece construction including shaped toe and heel portions each including overlapping flaps welded together along a central weld line. A tubular body portion joined to the sole member is of a height so as to cover at least a lower leg area of a wearer. A first retainer string or lace is affixed to a lower part of the body portion in the vicinity of the ankle of a wearer and, in use, surrounds that lower part. A first buckle is releasably secured to the retainer string so as to be slidable therealong and to be releasably fixed in position thereon to thereby enable tightening down of the first buckle against the body portion. A second retainer string is secured to a top part of the body portion, and a second buckle is releasably secured to this second retainer string so as to be slidable therealong and to be releasably fixed in position thereon, to thereby enable tightening down of the second buckle at the top part of the body portion to close off the boot.

20 Claims, 2 Drawing Sheets

PROTECTIVE BOOT FOR FOOTWEAR

FIELD OF THE INVENTION

The present invention relates to overboots and the like which are used to cover and protect the footwear of a user.

BACKGROUND OF THE INVENTION

Many different devices and techniques have been used over the years to protect the footwear against the effects of a wet, muddy and/or otherwise potentially damaging or hostile environment, ranging from relatively complex galoshes or overshoes to simple plastic bags put on the feet. Such protection is necessary or desirable under many different conditions including outdoor activities such as gardening, hiking, cycling, fishing, canoeing, camping, mountain climbing and the like, particularly in watery or muddy conditions. Similar protection is needed in commercial fields such as farming, manufacturing, health care, food processing and others, in both preventing contamination to the environment (e.g., to maintain industrial "clean room" conditions) and providing protection from the environment (e.g., against chemicals, dirt, etc.). Although prior art devices and techniques serve their purposes, few if any are of universal usefulness in the areas just described while still being relatively inexpensive and easy to use and store, yet rugged, durable and effective in providing waterproofing and dustproofing protection for the footwear and trousers of a wearer.

Patents of interest in this field include: U.S. Pat. Nos. 1,312,781 to Flannery; 1,644,217 to Wreford; 1,865,709 to Slocum; 4,616,428 to Leger; 4,788,780 to Boggs; 4,809,447 to Pacanowsky et al.; 5,067,260 to Jenkins, Jr.; Des. 267,832 to Pask; Des. 291,140 to Gjendemsjo. Briefly considering these patents, the Flannery patent discloses a overshoe boot made of waterproof material with securing straps located at the ankle and above and below the knee. The Wreford patent discloses a disposable overshoe made of paper material and using a drawstring for tying at the top of the overshoe to secure the overshoe to the wearer's leg. The Slocum patent discloses a protective overshoe-type garment which utilizes a pair of bags with drawstrings. The Leger patent discloses a slipper-type protective overshoe with elastic bands for securing the overshoe to the wearer's ankle. The Boggs patent discloses an overboot with an upper made of water-resistant material and including a strap around the ankle and a drawstring around the leg to secure the overboot. The Pacanowsky et al. patent discloses a waterproof breathable sock. The Jenkins, Jr. patent discloses an overboot wader made of waterproof material and utilizing a drawstring at the top. The Gjendemsjo patent discloses an overboot which utilizes a drawstring around the top of the boot and a string around the ankle. The Pask patent discloses a disposable overboot.

SUMMARY OF THE INVENTION

In accordance with the invention, a protective boot or overboot is provided which, in use, is worn over and protects conventional boots, shoes and other footwear. The boot is readily folded in a compact shape so as to fit into a small storage space such as is afforded, e.g., by a backpack, school bag, briefcase or jacket or coat pocket. The boot is of a shape such as to fit over most footwear, while still partially conforming to the footwear. Stated differently, the shape of the boot is such that the boot is very easy to put on over footwear of different styles and kinds, while still providing some fitting to the footwear particularly in the toe and heel areas. Retaining strings and associated buckles ensure a snug fit and enable the snugness of the fit to be controlled by the wearer or user. The boot is relatively inexpensive to make yet is both durable and effective.

In accordance with the invention, a protective boot is provided for wear over the footwear of a user, the boot comprising: a sole member of a one piece construction including a shaped toe portion including overlapping flaps welded together along a central weld line; a tubular body portion joined to said sole member and preferably of a height so as to extend at least to the mid-calf area of a wearer; and first and second retainer means for assisting in retaining the boot in place on a wearer. The first retainer means comprises a first retainer string or lacing element affixed to a lower part of the body portion in the vicinity of the ankle of a wearer and, in use, surrounding that lower part, and a first buckle member releasably secured to the first retainer string so as to be slidable therealong and to be releasably fixed in position thereon to thereby enable tightening down of the first buckle member against the body portion. The second retaining means comprises a second retainer string or lacing element secured to a top part of the body portion, and a second buckle member releasably secured to the second retainer string so as to be slidable therealong and to be releasably fixed in position thereon to thereby enable tightening down of the second buckle member at the top part of the body portion to close off the boot around the leg of a wearer.

Advantageously, a star weld is provided between said sole member and body portion at one end of said weld line. The sole member preferably includes a curved heel area formed by opposed, overlapping flaps of said sole member joined together along a further, substantially vertical weld line. A further star weld is advantageously provided between said sole member and body portion at one end of the further weld line. In a preferred embodiment, the heel area further includes a further, peaked flap overlapping and welded to the opposed flaps.

Preferably, the retainer means further comprises a mounting loop which is affixed to the boot and through which said first retainer string extends. In this embodiment, a star weld, corresponding to the further said weld mentioned above, is provided for affixing the mounting loop to the boot and for assisting in joining together of the sole member and body portion.

In a preferred implementation, the boot comprises a channel, extending around the top of the boot and formed by a folded-over part of body portion, in which the second retainer string is received, opposite ends of the channel terminating in spaced openings at the front of the boot through which opposite ends of the second string extend.

The sole member and said body portion each comprise preferably a polyester material with a protective coating. Advantageously, the polyester material of the sole member is of a greater weight and tensile strength than the polyester material of the body portion. Preferably, the protective coating comprises polyvinyl chloride, and the polyester material comprises warp knitted polyester.

Other features and advantages of the invention will be set forth in, or apparent from, the following detailed description of the preferred embodiment of the invention.

DESCRIPTION OF THE PREFERRED EMBODIMENTS

Figure 2:
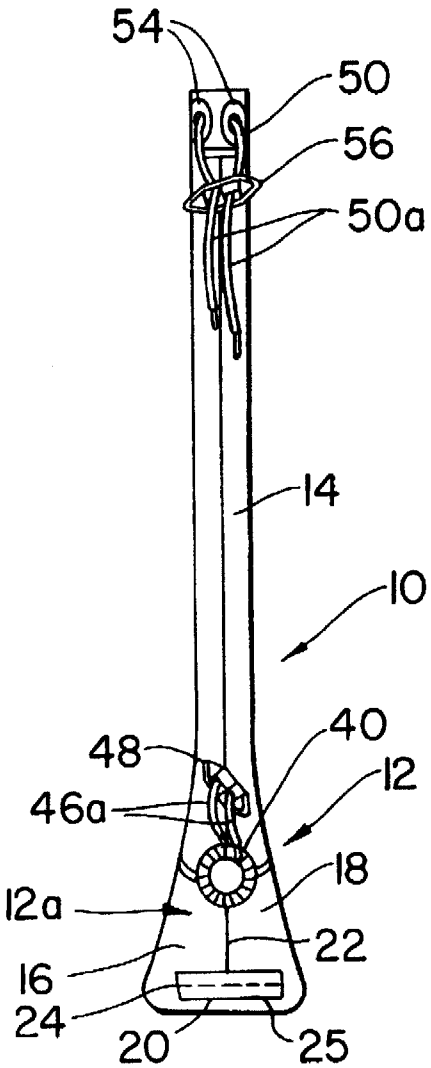
FIG. 2 is a front elevational view of the boot of FIG. 1.
Figure 1:
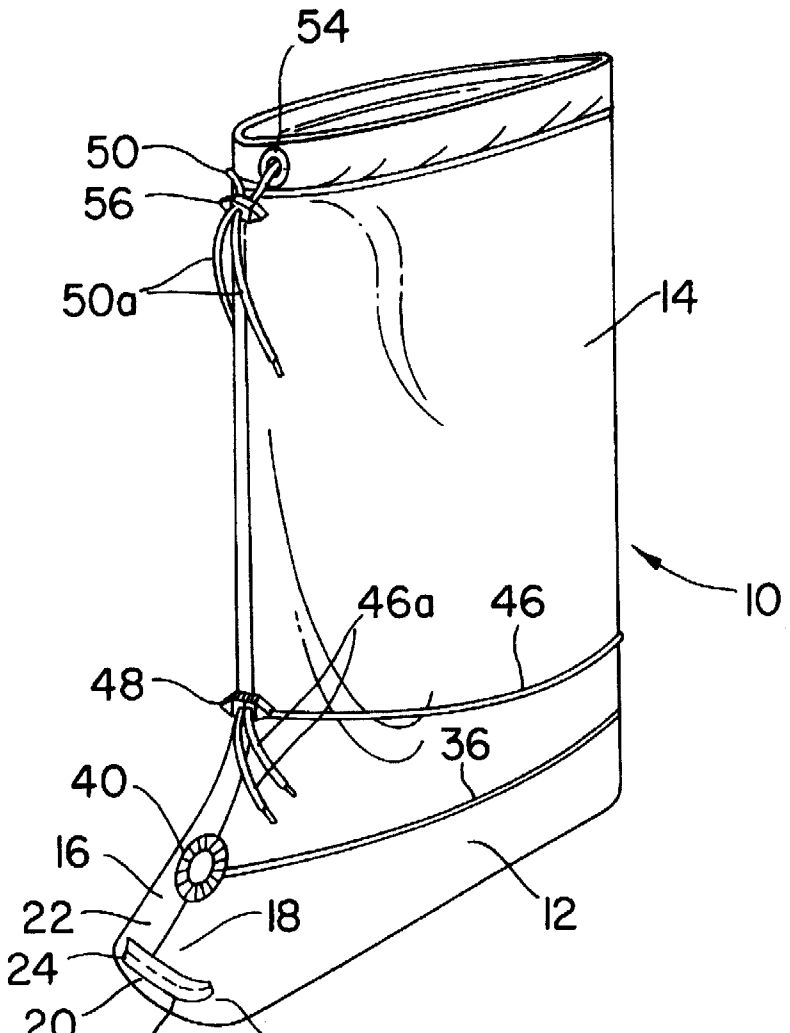
FIG. 1 is a perspective view of a boot construction or boot in accordance with a preferred embodiment of the invention.

Referring to FIGS. 1 to 4, there is shown a preferred embodiment of the boot construction of the invention. The boot or boot construction, which is generally denoted 10, basically comprises a sole 12 and a body or "shaft" portion 14 which covers the ankle and lower leg. (It will be appreciated that while a mid-calf embodiment is illustrated, the height of body portion 14 can, of course, be increased so as to cover part or all the upper leg in other embodiments.)

Sole 12 is made of a one piece water resistant material which, in an exemplary implementation, comprises a polyvinyl chloride (PVC) coated warp knitted polyester having a weight of approximately 600 gm/sq.m. and a Tensile Strength Warp of approximately 2500 N/5 cm. Sole 12 is formed from a blank (not shown) which is cut out so as to permit folding and welding thereof in the toe or front area 12*a* and in the heel or rear area 12*b*.

In the toe area 12*a*, the lateral edges of a pair of opposed end flaps or flap portions 16 and 18 of the blank are joined together in overlapping fashion by welding along a weld line 22 while the lower edges of flaps 16 and 18 are jointed to a bottom portion 20 in an overlapping fashion along a weld line 24. This overlapping of the mating edges of portions 16, 18 and 20 provides reinforcement in the top area 12*a*. Portions 16, 18 and 20 are shaped and gathered so as to form a curved or rounded gusseted front, as is perhaps best illustrated in FIGS. 1 and 3, to thus accommodate the toe of the foot wear worn by the user of the boot 10. A weld strip 25 is provided over weld line 24 to give additional reinforcement.

Figure 4:
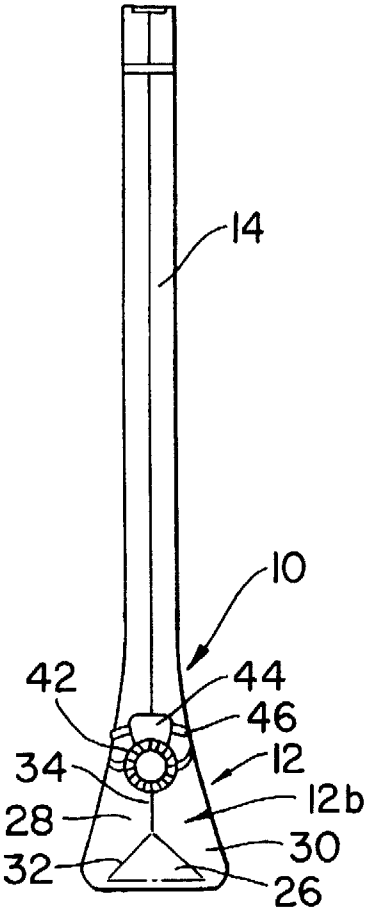
FIG. 4 is a rear elevational view of the boot of FIG. 1.
Figure 3:
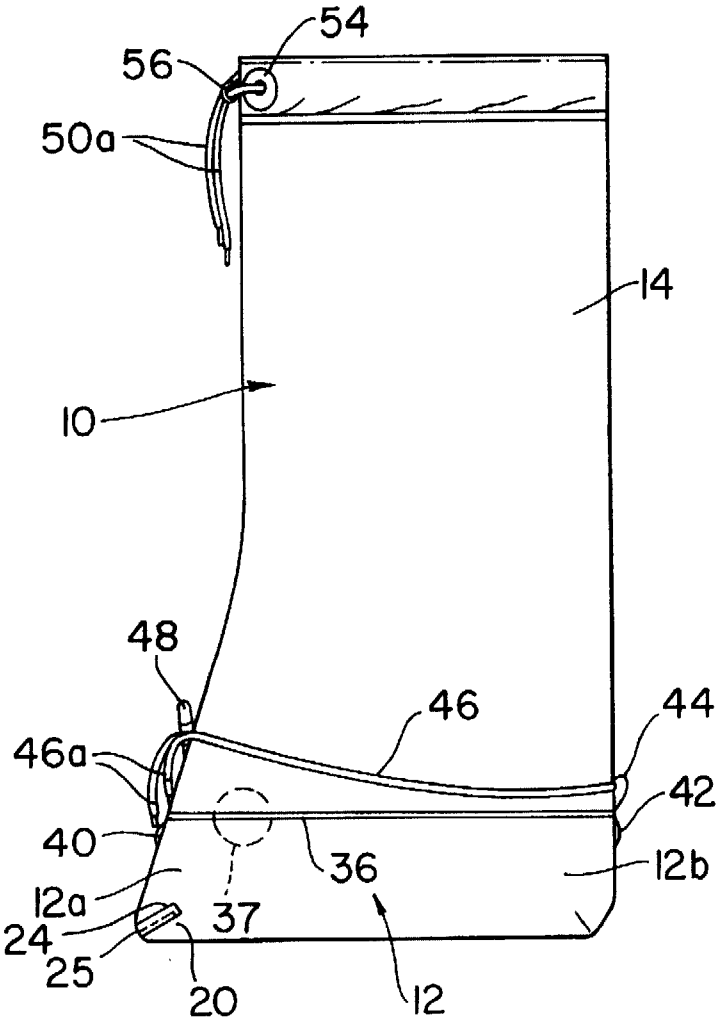
FIG. 3 is a side elevational view of the boot of FIG. 1.

As shown in FIG. 4 (and to a lesser extent in FIG. 3), somewhat similar gusseting of sole 12 is provided in heel area 12*b* to form the back portion of sole 12. In this regard, a generally triangular flap or flap portion 26 is created in the blank which overlaps with and is welded to lower edges of opposed end portions 28 and 30 along a weld line 32 and the opposed edges of these end portions 28 and 30 are overlapped and welded together along a generally vertical weld line 34. The portions 26, 28 and 30 are gathered and joined together to form the rounded or curved heel or rear portion 12*b* which, as illustrated in FIG. 3, has a generally straight, vertical profile as viewed from the side. It will be appreciated that, similarly to the toe portion 12*a*, the shaping of rear portion 12*b* accommodates the heel portion of the footwear of a user.

The body or shaft portion 14 is formed from two halves which are welded together along mating edges to form a shaped tube of the shape illustrated. Body portion 14 is also made of a water-resistant material and, in an exemplary embodiment, is of PVC coated warp knitted polyester having a weight of approximately 300 gm/sq.m. and Tensile Strength Warp of approximately 300 N/5 cm.

Figure 5:
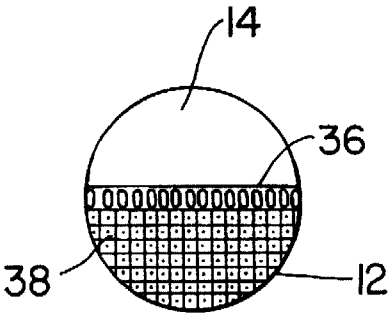
FIG. 5 is a detail, taken from FIG. 3 and drawn to an enlarged scale, of the boot of FIG. 1.

Body portion 14 and sole 12 are joined by welding mating edges thereof along a weld line 36, a portion of which is shown in more detail in FIG. 5. FIG. 5 is taken from the encircled area denoted 37 in FIG. 3. This weld, which creates the short vertical embossment lines or striations indicated at 36*a* in FIG. 5, ensures that the boot 10 is waterproof and dustproof. FIG. 5 also shows, at 38, the surface pattern on sole 12 in this exemplary embodiment. To provide additional reinforcement in the area where the body material and sole material are joined, a star weld 40 is provided about the toe area 12*a* of boot 10. Similarly, a second star weld 42 is provided above the heel area 12*b*, for the same purpose.

Star weld 42 is also used to secure an anchoring loop 44 (FIGS. 3 and 4) to the back or rear of boot 10. Anchoring loop 44 serves as an anchor for a tightening string or lace 46 which extends around the base of portion 14 and the ends of which, denoted 46*a*, are releasably secured together by a buckle 48. Buckle 48 is of a conventional lock-release construction that permits string 46 to be drawn tight and snugged down, and later released, as desired, by pulling on the buckle 48.

A second tightening string 50 is received in a circumferential channel 52 formed at the top of body portion or section 14 by doubling over a part of the free end thereof and welding the edge of the doubled over part to the inside wall of the body portion 14. The ends 50*a* of string 50 extend outwardly through a pair of spaced, grommeted openings 54 at the top front of body portion 14 and are joined together by a buckle 56 corresponding to buckle 48 described above.

It is to be understood that although the boot appears from the drawings to have sufficient stiffness so as to stand alone, such is not the case in a preferred implementation. In this regard, body portion 14 is generally quite flexible so as to readily fold up, and while sole member 12 is stiffer, the sides between the toe area 12*a* and heel area 12*b* lie flat together when the boot is not being worn and the sole member 12 is also quite easy to fold.

The boot 10 obviously has many uses. In general, as noted above, the boot serves as an overboot in the nature of galoshes or waders which is worn over conventional shoes or boots to provide waterproofing and dustproofing protection for the shoes and the portion of the trousers, slacks or leggings covered thereby. The boot is particularly useful while walking or standing in a watery, muddy or dusty environment. For example, the boot is ideal for use in connection with outdoor activities including those were there is wetness or rain or where wet or muddy grounds must be crossed, e.g., in gardening, farming, hiking, cycling, fishing, canoeing, camping, mountain climbing and the like. The boot is also well suited for use in work environments for, e.g., protecting against contamination in food processing plants, infection to animals on farms and slaughtering houses, and dust contamination in industrial clean rooms.

It will be appreciated from the foregoing that the boots are durable and lightweight and, in the latter regard, a pair of size "Large" boots weighs approximately 300 gm.sq.m. The boot is readily foldable so as to fit into a plastic carrying case or the like and or to fit into a backpack, school bag, briefcase, etc. The shape of boot 10 will fit over most footwear while generally confirming thereto to provide comfort. Of course, retaining strings 46 and 50, and associated buckles 48 and 52, ensure that the boot fits snugly and stays in place.

Although the present invention has been described to specific exemplary embodiments thereof, it will be understood by those skilled in the art that variations and modifications can be effected in these exemplary embodiments without departing from the scope and spirit of the invention.

What is claimed is:

1. A protective boot for wear over the footwear of a user, said boot comprising:

a sole member of a one piece construction including a shaped toe portion including overlapping flaps welded together along a central weld line;

a tubular body portion joined to said sole member and of a height so as to cover at least a lower leg area of a wearer; and first and second retainer means for assisting in retaining the boot in place on a wearer; said first retainer means comprising a first retainer string affixed to a lower part of said body portion in the vicinity of the ankle of a wearer and, in use, surrounding said lower part, and a first buckle member releasably secured to said first retainer string so as to be slidable therealong and to be releasably fixed in position thereon to thereby enable tightening down of said first buckle member against said body portion; and said second retaining means comprising a second retainer string secured to a top part of said body portion, and a second buckle member releasably secured to said second retainer string so as to be slidable therealong and to be releasably fixed in position thereon to thereby enable tightening down of said second buckle member at said top part of said body portion to close off the boot.

2. A boot as claimed in claim 1 further comprising a star weld between said sole member and body portion at one end of said weld line.

3. A boot as claimed in claim 2 wherein said sole member includes a curved heel area formed by opposed, overlapping flaps of said sole member joined together along a further, substantially vertical weld line.

4. A boot as claimed in claim 3 further comprising a further star weld between said sole member and body portion at one end of said further weld line.

5. A boot as claimed in claim 4 wherein said heel area further includes a further, peaked flap overlapping and welded to said opposed flaps.

6. A boot as claimed in claim 1 wherein said first retainer means further comprises a mounting loop which is affixed to the boot and through which said first retainer string extends.

7. A boot as claimed in claim 6 further comprising a star weld for affixing the mounting loop to the boot and for assisting in joining together of the sole member and body portion.

8. A boot as claimed in claim 1 further comprising a channel, extending around the top of the boot and formed by a folded-over part of body portion, in which said second retainer string is received, opposite ends of said channel terminating in spaced openings at the front of the boot through which opposite ends of said second string extend.

9. A boot as claimed in claim 1 wherein said sole member and said body portion each comprise a polyester material with a protective coating.

10. A boot as claimed in claim 9 wherein the polyester material of said sole member is of a greater weight and tensile strength than the polyester material of said body portion.

11. A boot as claimed in claim 10, wherein said protective coating comprises polyvinyl chloride.

12. A boot as claimed in claim 9 wherein said polyester material comprises warp knitted polyester.

13. A protective outer boot for wear over the footwear of a user to protect the foot and at least the lower leg area, said boot comprising:

a water-resistant sole member of a one piece construction defining an upper opening and comprising a shaped toe portion including overlapping flaps welded together along a first central weld line, straight sides which lie substantially flat together when the boot is not in use, and a rounded heel portion including opposed overlapping flaps welded together along a further central weld line disposed opposite to said first central weld line;

a tubular body portion welded to said sole member along said upper opening and of a height so as to cover at least a lower leg area of a wearer; and first and second retainer means for assisting in retaining the boot in place on a wearer; said first retainer means comprising a first retainer string which is affixed to a lower part of said body in the vicinity of the ankle of a wearer and which, in use, surrounding said lower part, and a first buckle member releasably secured to said first retainer string so as to be slidable therealong and to be releasably fixed in position thereon to thereby enable tightening down of said first buckle member against said body portion; and said second retaining means comprising a second retainer string secured to a top part of said body portion, and a second buckle member releasably secured to said second retainer string so as to be slidable therealong and to be releasably fixed in position thereof to thereby enable tightening down of said second buckle member at said top part of said body portion to close off the boot.

14. A boot as claimed in claim 13 further comprising a star weld between said sole member and body portion at one end of said weld line.

15. A boot as claimed in claim 14 further comprising a further star weld between said sole member and body portion at one end of said further weld line.

16. A boot as claimed in claim 15 wherein said heel area further includes a further, peaked flap overlapping and welded to said opposed flaps of said heel area.

17. A boot as claimed in claim 13 wherein said first retainer means further comprises a mounting loop which is affixed to the boot and through which said first retainer string extends.

18. A boot as claimed in claim 17 further comprising a star weld for affixing the mounting loop to the boot and for assisting in joining together of the sole member and body portion.

19. A boot as claimed in claim 13 further comprising a channel, extending around the top of the boot and formed by a folded-over part of body portion, in which said second retainer string is received, opposite ends of said channel terminating in spaced openings at the front of the boot through which opposite ends of said second string extend.

20. A boot as claimed in claim 13 wherein said sole member and said body portion each comprise a polyester material with a protective coating, the polyester material of said sole member being of a greater weight and tensile strength than the polyester material of said body portion.

* * * * *